United States Patent [19]

Giles

[11] Patent Number: 5,058,641

[45] **Date of Patent: * Oct. 22, 1991**

[54] LOG SURFACE HEWING PROCESS

[75] Inventor: Randy K. Giles, Jefferson County, Tenn.

[73] Assignee: Hearthstone Builders, Inc., Dandridge, Tenn.

[ * ] Notice: The portion of the term of this patent subsequent to Oct. 3, 2006 has been disclaimed.

[21] Appl. No.: 555,110

[22] Filed: Jul. 20, 1990

[51] Int. Cl.[5] ..... B27L 5/02

[52] U.S. Cl. ..... 144/369; 144/3 R; 144/134 R; 144/137; 144/375

[58] Field of Search ..... 144/2 R, 3 R, 134 R, 144/162 R, 370, 137, 375, 369

[56] References Cited

U.S. PATENT DOCUMENTS

| | | | |
|---|---|---|---|
| 3,703,198 | 11/1972 | Luebs et al. | 144/2 R |
| 3,756,295 | 9/1973 | Halop | 144/2 R |
| 3,779,294 | 12/1973 | Gillis | 144/134 R |
| 4,046,180 | 9/1977 | Marshall et al. | 144/137 |
| 4,871,003 | 10/1989 | Lucas et al. | 144/3 R |
| 4,949,768 | 8/1990 | Giles et al. | 144/137 |

*Primary Examiner*—W. Donald Bray
*Attorney, Agent, or Firm*—Pitts & Brittian

[57] ABSTRACT

A process for reconfiguring the surfaces of a construction log (10) used in the construction of log structures to produce a log having the appearance of a hand-hewn log. The process includes a first step (30) of chamfering at least the upper and lower forward edge portions (22 and 24) of the log body (12) to produce upper and lower irregularly beveled forward corners (22' and 24'), and a second step (34) of cutting a plurality of indentations (38) into at least the front surface (18) of the log body (12) to produce an irregular front surface.

13 Claims, 4 Drawing Sheets

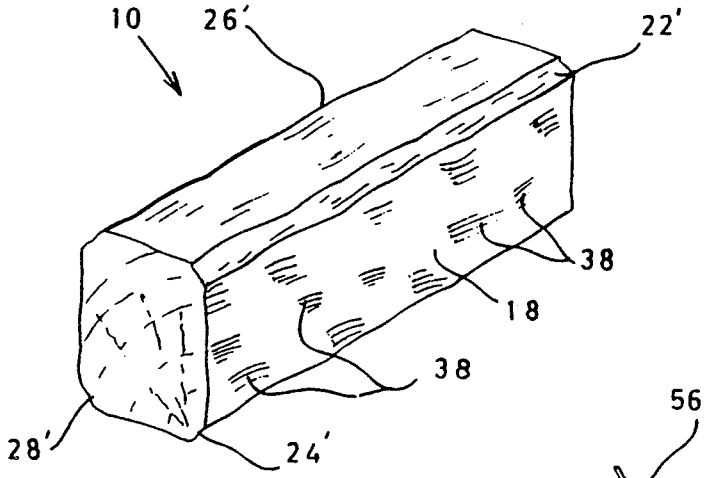
FIG. 7
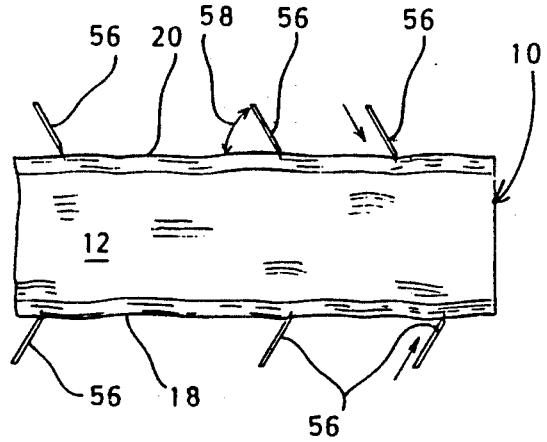
FIG. 8
FIG. 9
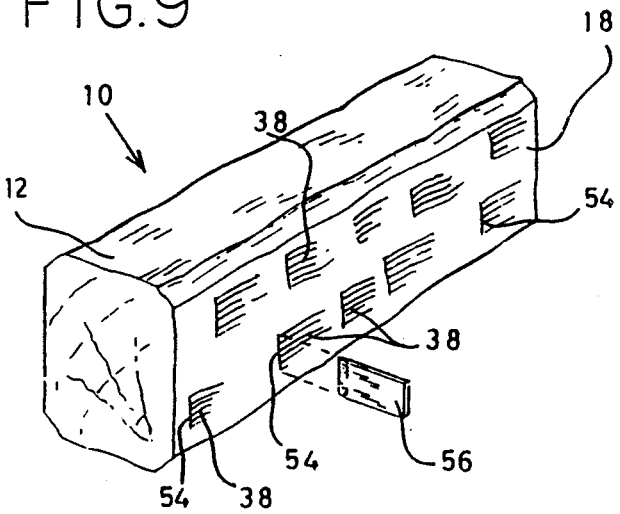
FIG. 10A
PRIOR ART
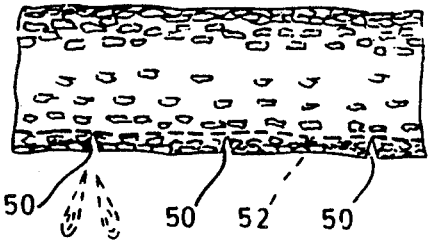
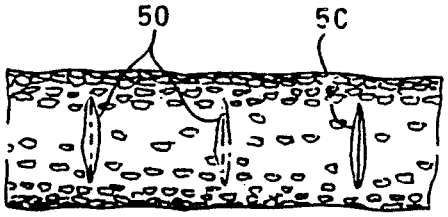
FIG. 10B
PRIOR ART

LOG SURFACE HEWING PROCESS

This application in part discloses and claims subject matter disclosed in our earlier filed pending application, Ser. No. 07/425,808, filed Oct. 23, 1989, now U.S. Pat. No. 4,949,768.

TECHNICAL FIELD

This invention relates to a log surface hewing process for reconfiguring certain surfaces of a construction log used in the construction of log structures to provide a log having the appearance of a hand-hewn log. The process generally includes the steps of chamfering the edge portions of the log, and cutting a plurality of selectively configured indentations into the surfaces of the log.

BACKGROUND ART

In recent years, there has been a resurgence in the popularity of log homes and other log structures. However, most of the log structures built in recent years look very little like the early log structures which were constructed of hand-hewn logs, and, thus, lack the authenticity and charm of traditional log structures. This is mainly due to the fact that the logs used are produced using contemporary milling processes which result in the logs defining rectangular cross-sections and planar surfaces, rather than the irregular features of a traditionally produced hand-hewn log. In this regard, certain conventional log milling processes and devices are disclosed in U.S. Pat. Nos. 3,957,095; 4,167,961; 4,168,675; 4,230,163; 4,509,571; and 4,519,429.

Therefore, it is an object of the present invention to provide a log surfacing process for reconfiguring the surface of a construction log used in the construction of log structures to provide a log having the appearance of a traditional hand-hewn log.

Another object of the present invention is to provide a log surfacing process for mass producing logs having a hand-hewn appearance in a quick and efficient manner.

Yet another object of the present invention is to provide a log surfacing process which is inexpensive to use such that logs having a hand-hewn appearance can be produced at a low cost.

DISCLOSURE OF THE INVENTION

Other objects and advantages will be accomplished by the present invention which provides a log surface hewing process for reconfiguring the surfaces of a construction log used in the construction of log structures to produce a log having the appearance of a hand-hewn log. The process is applied to a conventional construction log comprising an elongated body defining a substantially rectangular cross-section. The elongated body further defines oppositely disposed front and rear surfaces, longitudinally extending upper and lower forward edge portions, and longitudinally extending upper and lower rearward edge portions. The process generally comprises the steps of chamfering at least the upper and lower forward edge portions of the log body with a first power driven rotary cutting means to produce irregularly beveled upper and lower forward corners. A plurality of indentations are then cut in at least the front surface of the log body using a second power driven rotary cutting means to produce an irregular front surface. Finally, in the preferred application of the method, a third power driven cutting means is used to score at least the front surface of the log body to provide a plurality of laterally disposed cuts in the front surface. Resultantly, when the log is incorporated into a log structure, the irregular features produced by the irregular beveling of the edge portions, and the cutting and scoring of the forward surface, give the log the appearance of having been hand-hewn.

BRIEF DESCRIPTION OF THE DRAWINGS

The above-mentioned steps of the present invention will become more clearly understood from the following detailed description of the invention read together with the drawings in which:

FIG. 7 is a partial perspective view of a construction log after the steps of chamfering the edge portions of the log and cutting indentations into the front and rear surfaces of the log pursuant to the present invention;

FIG. 8 is a partial top view of a construction log diagrammatically illustrating the step of scoring of the front and rear surfaces of the log body pursuant to the process of the present invention;

FIG. 9 is a partial perspective view of a construction log after application of the process of the present invention;

FIG. 10A is a partial top view of a log diagrammatically illustrating the scoring of the log with hand-hewing tools in accordance with traditional log hewing methods; and FIG. 10B is a partial side elevation view of a log diagrammatically illustrating the scoring of the log with hand-hewing tools in accordance with traditional log hewing methods.

BEST MODE FOR CARRYING OUT THE INVENTION

Figure 3A:
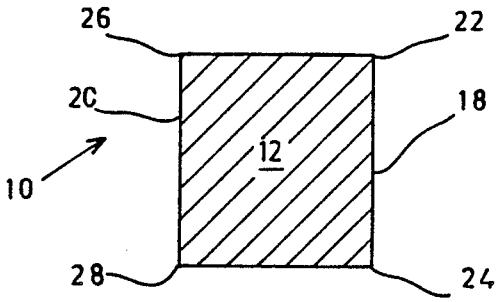
FIG. 3A is an end view, in section, of a construction log prior to application of the process of the present invention.

The various steps of the process of the present invention are diagrammatically illustrated in FIGS. 1A–E. The process is utilized to reconfigure various surfaces of a construction log used to produce log structures such that the log gives the appearance of being hand-hewn. Of course, the use of logs having a hand-hewn appearance gives the resulting log structure the look of an authentic log structure. Prior to application of the process, the construction log, illustrated at 20 in FIG. 1A comprises an elongated body 12 defining a substantially rectangular cross-section. (see FIG. 3A) The body 12 includes first and second opposite end portions 14 and 16, respectively, and defines a longitudinal axis therebetween. The body 12 further defines a substantially planar first surface 18, a substantially planar second surface 20, longitudinally extending upper and lower forward edge portions 22 and 24, respectively, and longitudinally extending upper and lower rearward forward edge portions 22 and 24, respectively, and longitudinally extending upper and lower rearward edge portions 26 and 28, respectively.

Figure 1A:
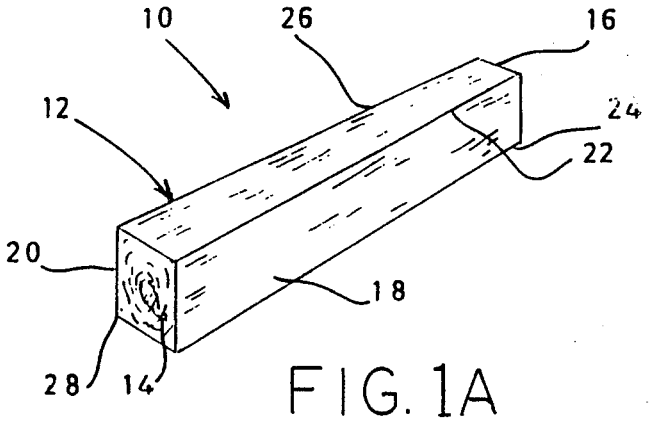
FIGS. 1A–E illustrate diagrammatic depictions of certain steps of the process of the present invention.
Figure 1B:
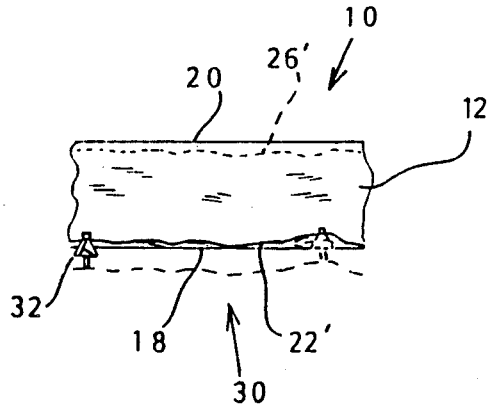
Figure 2:
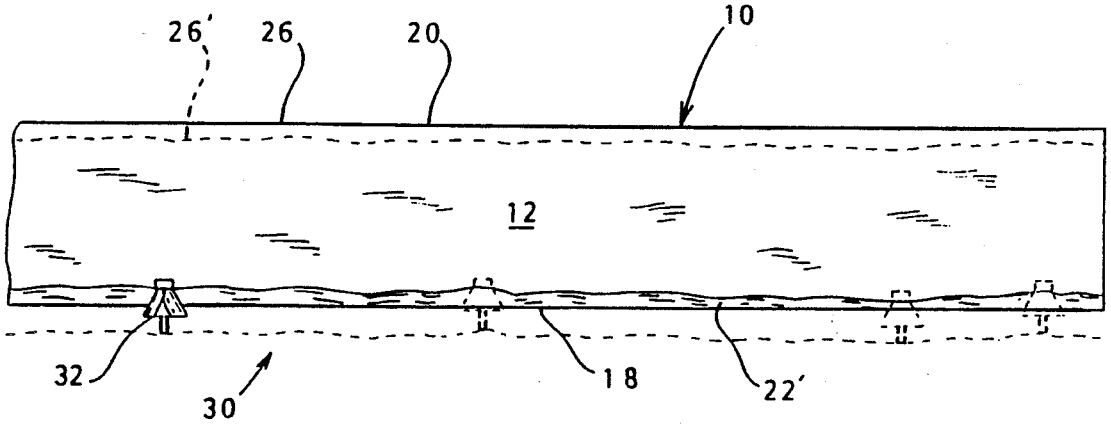
FIG. 2 illustrates a top view of a log diagrammatically illustrating the chamfering of the edge portions of the log during the application of the first step of the process of the present invention.
Figure 3B:
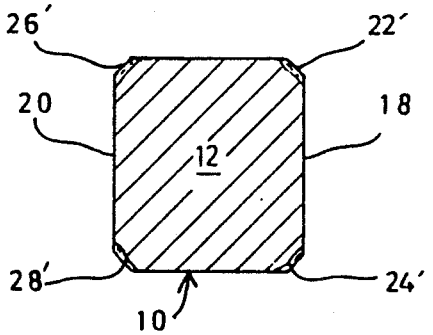
FIG. 3B is an end view, in section, of a construction log after the step of chamfering of the edge portions of the log pursuant to the process of the present invention.
Figure 4:
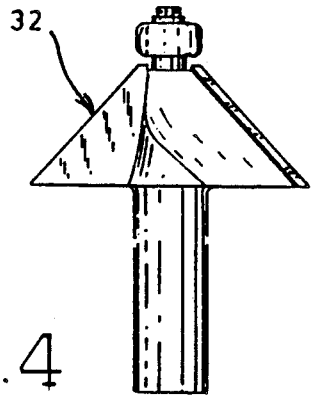
FIG. 4 is a side elevation view of one suitable chamfering bit for chamfering the edge portions of a construction log in accordance with the process of the present invention.

Whereas, the order of the various steps of the process may vary, in the preferred application of the process of the present invention, the first step, illustrated at 30 in FIGS. 1B and 2, comprises the chamfering of the edge portions 22, 24, 26 and 28 of the body 12 to remove the right angle corner defined at such edge portions. More specifically, a first power driven cutting means, which in the preferred embodiment comprises a routing device (not shown) provided with a chamfer bit 32 (see FIG. 4), is used to cut away the right angled corners, with the depth of cut of the bit 32 being selectively varied along the length of the body 12 to produce the irregularly beveled corners 22', 24', 26' and 28'. (see FIG. 3B) This irregular chamfering of the edge portions 22, 24, 26 and 28 can be accomplished by selectively reciprocating the bit 32 (and/or the router which rotates the bit 32) along its axis of rotation as the log is moved past the router in cutting contact with the bit. Resultantly, the depth of cut increases as the bit 32 is moved forward and the depth of cut decreases as the bit 32 is moved rearwardly. Of course, if desired, this step can be accomplished through travel of the first cutting means along the length of the log 10 rather than by travel of the log past the cutting means, but it will be appreciated that for purposes of mass production, it is more efficient to move the logs 10, as by a conveyor belt or other conveying device, past the cutting means. Further, it will be understood that by providing the first cutting means with a plurality of routing devices carrying the bits 32, the edge portions 22, 24, 26 and 28 can be cut simultaneously as the log 10 travels down the conveyor device.

It will be appreciated that the irregularly beveled corners 22', 24', 26' and 28' simulate the irregular corner surfaces which would result from the hand-hewing of the log 10 using conventional hand-manipulated cutting tools. In this regard, it will be understood that for certain applications, it may be necessary, or desirable, for only one side of the wall of a structure to depict an authentic appearance. In such situations, only the forward edge portions 22 and 24 need be chamfered so as to produce only the beveled corners 22' and 24'.

Figure 1C:
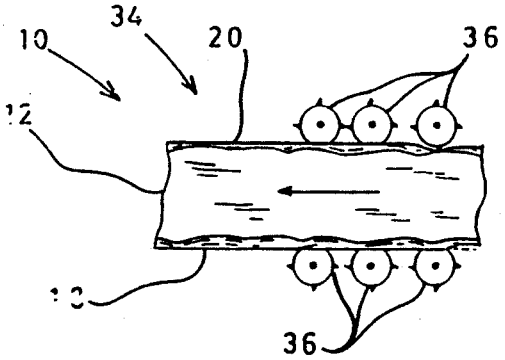
Figure 1D:
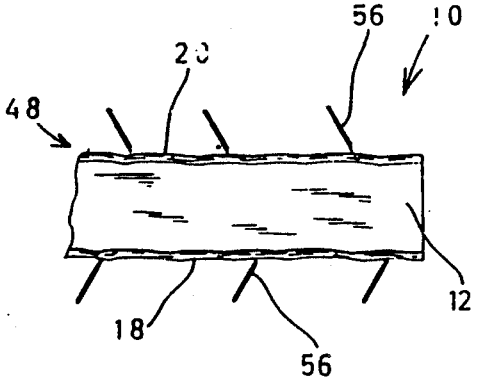
Figure 1E:
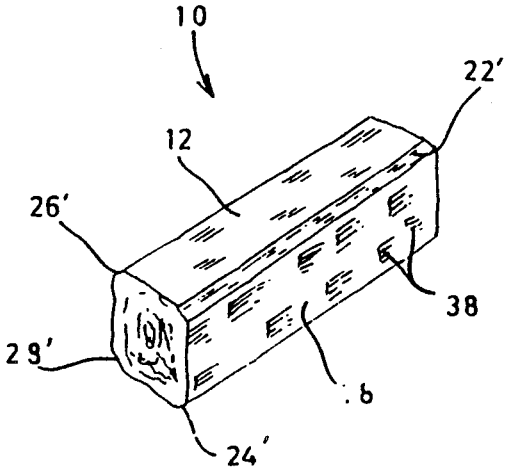
Figure 5A:
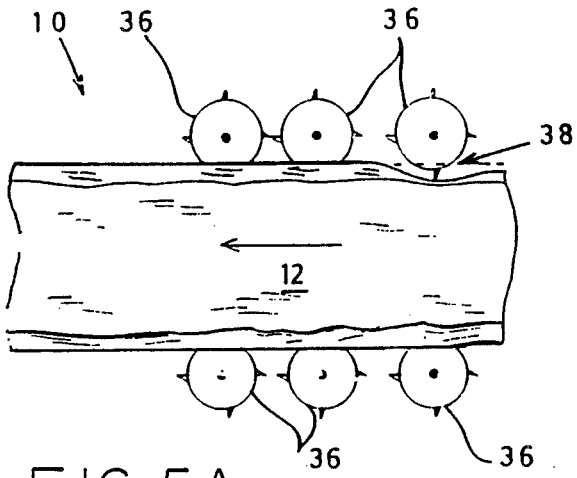
FIG. 5A is a top view of a construction log diagrammatically illustrating the step of cutting a plurality of indentations into the front and rear surfaces of such log pursuant to the process of the present invention.
Figure 5B:
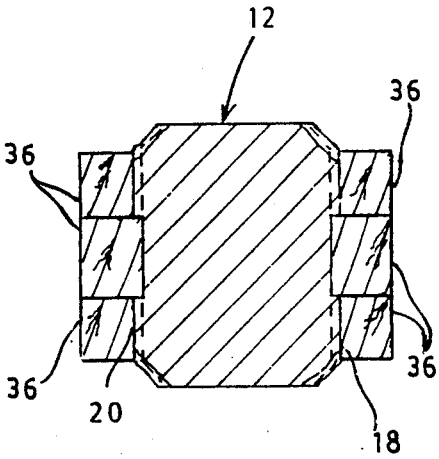
FIG. 5B is an end view of a construction log diagrammatically illustrating the step of cutting a plurality of indentations into the front and rear surfaces of the log pursuant to the process of the present invention.
Figure 5C:
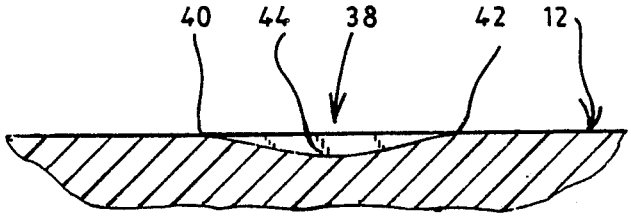
FIG. 5C is a partial top view, in section, of a construction log depicting an indentation cut in the log body in accordance with the process of the present invention.
Figure 6A:
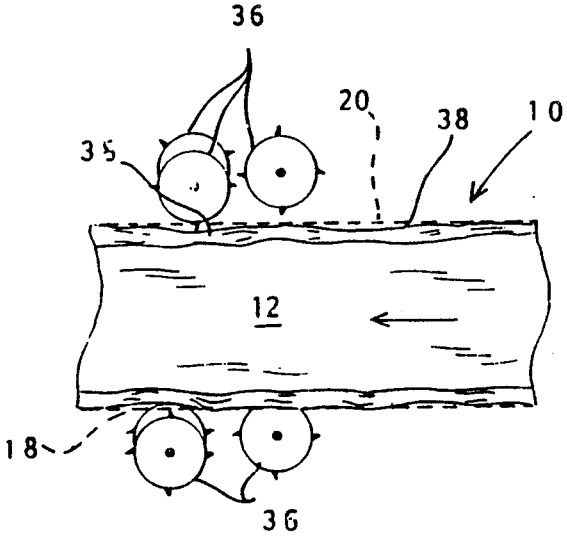
FIG. 6A is a top view of a construction log diagrammatically illustrating the step of cutting a plurality of indentations into the front and rear surfaces of the log pursuant to the process of the present invention.
Figure 6B:
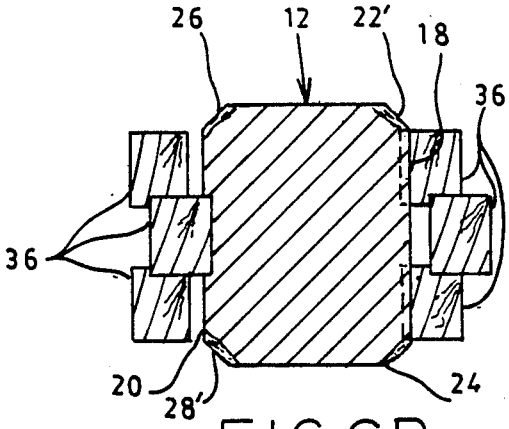
FIG. 6B is an end view of a construction log diagrammatically illustrating the step of cutting a plurality of indentations into the front and rear surfaces of the log pursuant to the process of the present invention.

The second step of the process of the present invention is illustrated at 34 in FIG. 1C and FIGS. 5A, B and C. In the second step 34, second power driven cutting means, which, in the preferred embodiment, includes one or more rotary cutting devices (not shown) and the rotating cutting blades 36, is used to cut a plurality of concaved indentations 38 in the front and rear surfaces 18 and 20. Each of the resulting indentations 38 defines a first and second, substantially laterally disposed edges 40 and 42, respectively, and a concaved surface 44 extending substantially longitudinally therebetween such that the indentations 38 mimic the cut of a manually wielded ax, adz, or similar hand-manipulated cutting tool. As illustrated in FIG. 5B, in the preferred application of the process, three blades 36 are provided for each of the surfaces 18 and 20, with the blades 36 being laterally spaced with respect to the surfaces 18 and 20 such that the blades 36 cut indentations 38 at three different levels at selected intervals along the length of the surfaces 18 and 20. Of course, the blades 36 can be longitudinally spaced with respect to the log 10 (see FIG. 5A) such that as the blades 36 are simultaneously brought into cutting contact with the log 10, the resulting indentations 38 are staggered to give the visual effect of the arbitrarily positioned cuts resulting from manual hewing with a hand tool. However, an even more authentic surface pattern can be achieved by individually manipulating each blade 36, as illustrated in FIGS. 6A and B, such that the indentation pattern cut by the blades 36 is not repeated along the length of the log 10. It will also be noted that the blades 36 can be positioned to have overlapping cutting paths (see FIG. 6B) such that the indentations 38 can be made to overlap just as the manual cuts of an ax, adz, or other hand tool would overlap.

Of course, as discussed with respect to the step of chamfering the edge portions of the log 10, for certain applications it may be necessary, or desirable, to cut the indentations 38 in only one of the surfaces 18 or 20. Further, it will be understood that, whereas in the preferred application of the process three blades 36 are utilized for cutting each of the surfaces 18 and 20, the number of blades 36 utilized can vary.

FIG. 7 depicts a log 10 after steps 30 and 34 have been completed. Whereas, at this point in the process, the log 10 generally defines the irregular surface features of a hand-hewn log, the authentic appearance of the log 10 can be further enhanced by a third processing step illustrated at 48 in FIGS. 1D and 8. With respect to the third step 48, it will be recognized by those skilled in the art that when a log is being hand-hewn, one of the favored traditional methods for producing substantially planar surfaces is to score the log along its length with a plurality of laterally disposed scoring cuts 50 as illustrated in FIGS. 10A and B. Usually an ax 46 or adz is used to produce the cuts 50. The section of wood between the cuts 50 is then hewn away with an ax or adz to produce a substantially planar, yet irregular, surface 52. However, when the wood between the cuts 50 is removed, remnants of the scoring cuts are still visible along the length of the log. In the third step 48 of the present invention, a third power driven cutting means is used to score the surfaces 18 and 20 with a plurality of substantially laterally disposed cuts 54 which mimic the remnants of the scoring cuts 50.

In the preferred embodiment, the third cutting means comprises one or more reciprocating cutters (not shown) provided with chisel-type blades diagrammatically illustrated at 56. These blades 56 are preferably disposed at an angle other than 90 degrees relative to the axis of the log 10, and preferably disposed such that the angle 58 (see FIG. 8) is in between 50 and 70 degrees. In this regard, it had been found that where the blades 56 are disposed at an angle approximating the angle 58, the resulting cuts 54 more closely resemble the scoring marks produced by hand-hewn techniques. Further, preferably the cuts 54 are made at, or proximate, either the first edge 40 or the second edge 42 of the indentations 38. (see FIG. 9) Once again, such placement of the cuts 54 more closely mimics the surface configuration of a hand-hewn log. Of course, varying numbers of blades 56 can be used for scoring the surfaces 18 and/or 20.

In light of the above, it will be appreciated that the process of the present invention produces a log which closely resembles a hand-hewn log when incorporated into a log structure. Whereas a preferred application has been shown and described, it will be understood that there is no intent to limit the process of the present invention to such disclosure, but, rather, it is intended to cover all modified and alternate applications falling within the spirit and scope of the invention as defined in the appended claims.

I claim:

1. A log surface hewing process for reconfiguring the surfaces of a construction log used in the construction of log structures to produce a log having the appearance of a hand-hewn log, said process being applied to a construction log comprising an elongated body defining a substantially rectangular cross-section, and including first and second end portions and a longitudinal axis extending therebetween, said body further defining front and rear oppositely disposed surfaces and longitudinally extending upper and lower forward edge portions and longitudinally extending upper and lower rearward edge portions, said process comprising the steps of:

chamfering at least said upper and lower forward edge portions of said body using a first power driven rotary cutting means to produce irregularly beveled upper and lower forward corners; and cutting a plurality of indentations in at least said front surface of said body using a second power driven rotary cutting means.

2. The process of claim I wherein said first cutting means comprises at least one routing device provided with a chamfering bit, and wherein said step of chamfering said upper and lower forward edge portions of said body further includes selectively varying the depth of cut of said chamfering bit along the length of said body whereby said irregularly beveled corners are produced.

3. The process of claim 1 wherein said step of chamfering said edge portions includes the chamfering of said upper and lower rearward edge portions to produce irregularly beveled upper and lower rearward corners.

4. The process of claim 3 wherein said first cutting means comprises at least one routing device provided with a chamfering bit, and wherein said step of chamfering said upper and lower forward edge portions and said upper and lower rearward edge portions of said body further includes selectively varying the depth of cut of said chamfering bit along the length of said body whereby said irregularly beveled corners are produced.

5. The process of claim 1 wherein said step of cutting a plurality of indentations includes cutting a plurality of said indentations in said front and rear surface of said body.

6. The process of claim 1 wherein each said indentation defines a substantially laterally disposed first edge and a substantially laterally disposed second edge, with a concaved surface extending substantially longitudinally therebetween.

7. The process of claim 5 wherein each said indentation defines a substantially laterally disposed first edge and a substantially laterally disposed second edge, with a concaved surface extending substantially longitudinally therebetween.

8. The process of claim 1 wherein said step of cutting said indentations includes cutting said indentations on a plurality of lateral levels and wherein at least some said indentations are positioned so as to overlap adjacently cut indentations.

9. The process of claim 6 wherein said step of cutting said indentations includes cutting said indentations on a plurality of lateral levels and wherein at least some said indentations are positioned so as to overlap adjacently cut indentations.

10. The process of claim 7 wherein said step of cutting said indentations includes cutting said indentations on a plurality of lateral levels and wherein at least some said indentations are positioned so as to overlap adjacently cut indentations.

11. A log surface hewing process for reconfiguring the surfaces of a construction log used in the construction of log structures to produce a log having the appearance of a hand-hewn log, said process being applied to a construction log comprising an elongated body defining a substantially rectangular cross-section, and including first and second end portions and a longitudinal axis extending therebetween, said body further defining front and rear oppositely disposed surfaces and longitudinally extending upper and lower forward edge portions and longitudinally extending upper and lower rearward edge portions, said process comprising the steps of:

chamfering at least said upper and lower forward edge portions of said body using a first power driven rotary cutting means to produce irregularly beveled upper and lower forward corners, said first cutting means comprising at least one routing device provided with a chamfering bit, the depth of cut of said chamfering bit being selectively varied along the length of said body whereby said irregularly beveled corners are produced; and cutting a plurality of indentations in at least said front surface of said body using a second power driven rotary cutting means, each said indentation defining a substantially laterally disposed first edge and a substantially laterally disposed second edge, with a concaved surface extending substantially longitudinally therebetween, said indentations being cut on a plurality of lateral levels and at selected intervals along the length of said body, at least some of said indentations being positioned so as to overlap other said indentations.

12. The process of claim 11 wherein said step of chamfering said edge portions includes the chamfering of said upper and lower rearward edge portions to produce irregularly beveled upper and lower rearward corners.

13. The process of claim 12 wherein said step of cutting a plurality of indentations includes cutting a plurality of said indentations in said front and rear surface of said body.

* * * * *